United States Patent [19]

McManus

[11] Patent Number: 4,827,602

[45] Date of Patent: May 9, 1989

[54] ELECTRIC HEATER ASSEMBLY FIXTURE AND METHOD OF USE

[75] Inventor: John R. McManus, Marcellus, N.Y.

[73] Assignee: Carrier Corporation, Syracuse, N.Y.

[21] Appl. No.: 208,625

[22] Filed: Jun. 20, 1988

[51] Int. Cl.[4] ..... H05B 3/06

[52] U.S. Cl. ..... 29/611; 29/621; 29/173; 29/739; 29/759; 29/566; 140/89

[58] Field of Search ..... 29/611, 621, 739, 759, 29/566, 564.1, 173; 254/10.5; 140/89; 72/298; 338/304; 219/532, 536

[56] References Cited

U.S. PATENT DOCUMENTS

| | | | |
|---|---|---|---|
| 2,169,248 | 8/1939 | Holister | 140/89 |
| 4,458,141 | 7/1984 | Howard et al. | 338/304 |
| 4,528,441 | 7/1985 | Seal et al. | 338/304 |
| 4,628,189 | 12/1986 | Danko | 338/304 |

*Primary Examiner*—P. W. Echols

*Attorney, Agent, or Firm*—David J. Zobkiw

[57] ABSTRACT

A U-shaped coil is place on the fixture of the present invention and is folded such that each arm of the U is made into a U. The folded coil is then placed upon the insulators of a tree or rack through further movement of the fixture.

11 Claims, 11 Drawing Sheets

ELECTRIC HEATER ASSEMBLY FIXTURE AND METHOD OF USE

BACKGROUND OF THE INVENTION

Electrical resistance heating assemblies of the type employing a coiled resistance element require the manipulation of the coil with respect to the supporting electrical insulators during their assembly. The insulators are secured to a tree or rack and support and locate the coil. Commonly assigned U.S. Pat. No. 4,528,441 discloses different insulator designs and one scheme for manipulating the coil and insulator to secure the coil in place. Commonly assigned U.S. application Ser. No. 92,815 filed Sept. 3, 1987, which is hereby incorporated by reference, discloses an adjustable coil retainer and spreader which can be used in conjunction with the present invention.

SUMMARY OF THE INVENTION

The present invention is directed to a fixture for installing heater elements onto ceramic insulators. The fixture receives a U-shaped coil which is folded in another plane into a U-shape which is then caused to be placed on the insulators of a tree or rack by manipulating the coil as described in U.S. application Ser. No. 92,815.

It is an object of this invention to provide a method and apparatus for installing heater elements onto ceramic insulators.

It is another object of this invention to provide a method and apparatus for folding a heater element without significantly stretching or breaking the coils.

It is a further object of this invention to provide a method and apparatus for uniformly installing heater elements onto ceramic insulators. These objects, and others as will become apparent hereinafter, are accomplished by the present invention. Basically a U-shaped coil is folded such that each arm of the U is made into a U. The coil is then placed upon the insulators of a tree or rack.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
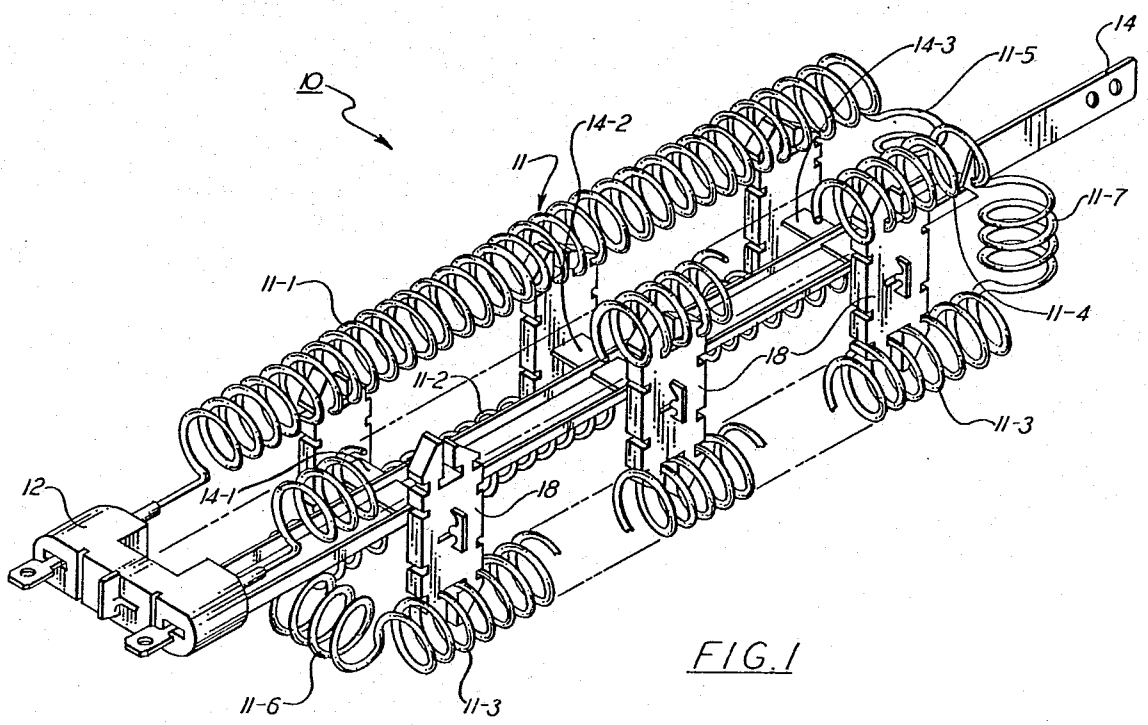
FIG. 1 is a perspective view of an assembled coil.
Figure 2:
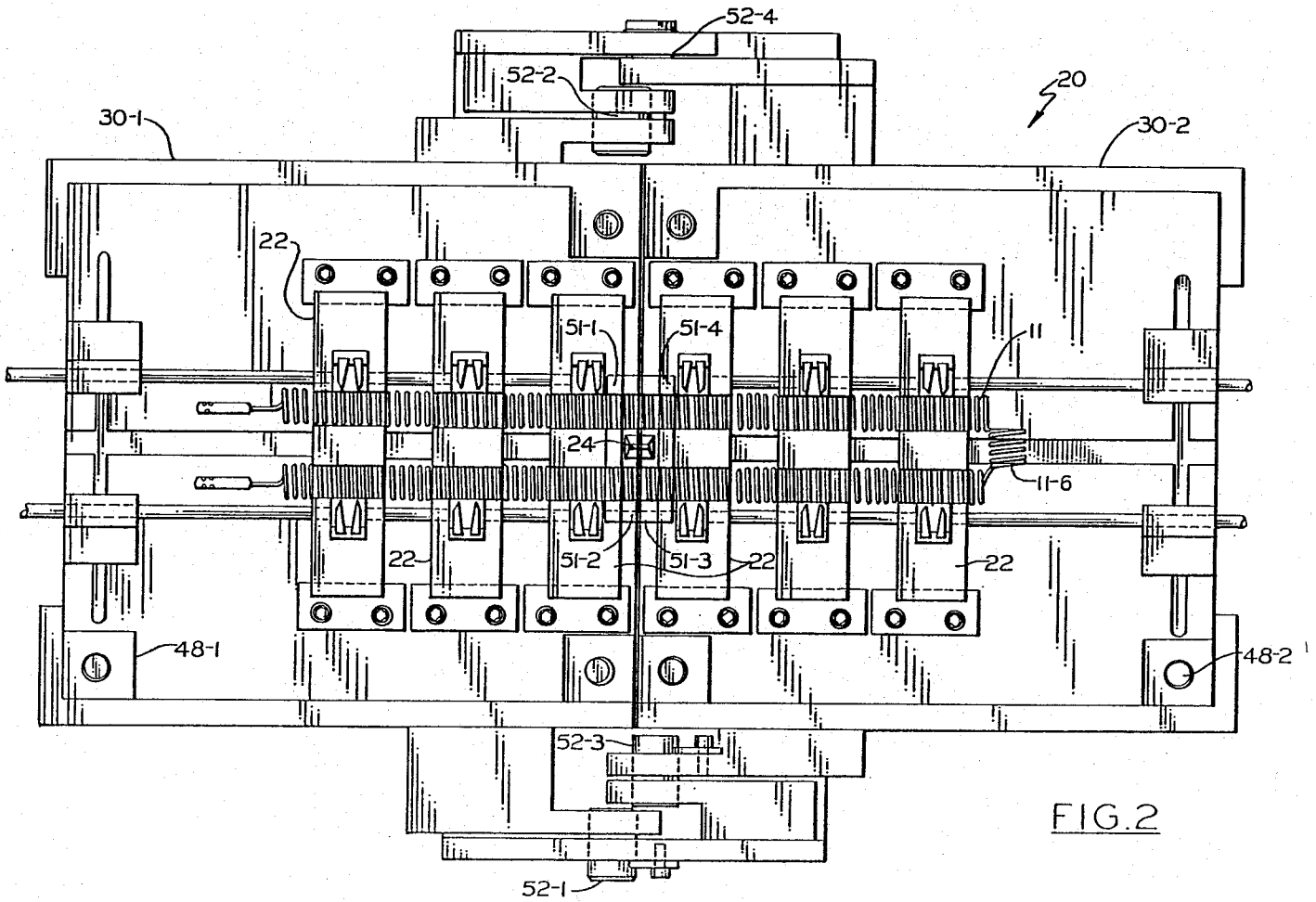
FIG. 2 is a front view of the fixture of the present invention.

In FIG. 1, the numeral 10 generally designates an electric resistance heating coil which has been made according to the teachings of the present invention. The wire coil 11 is made up of four long legs or branches 11-1 to 4 connected by short legs or branches 11-5 to 7 and terminates in spade plug 12. Coil 11 is supported on tree or rack 14 by a plurality of ceramic insulators 18 which are located on the ends of branches 14-1 to 3 of the rack. Referring now to FIG. 2, coil 11 is located on the fixture, 20, for installing heater elements. It will be noted the only short leg or branch 11-6 of coil 11 has been completed relative to the final configuration of FIG. 1 and this was done in a process which, while related to, is not a part of the present invention. In the disclosed embodiment of the tree or rack 14, there are six ceramic insulators 18 and, accordingly, six adjustable coil retainer and spreaders 22 such as those disclosed in application Ser. No. 92,815. Opening 24 is formed in fixture 20 for receiving the end of tree or rack 14 as will be explained below.

Figure 3:
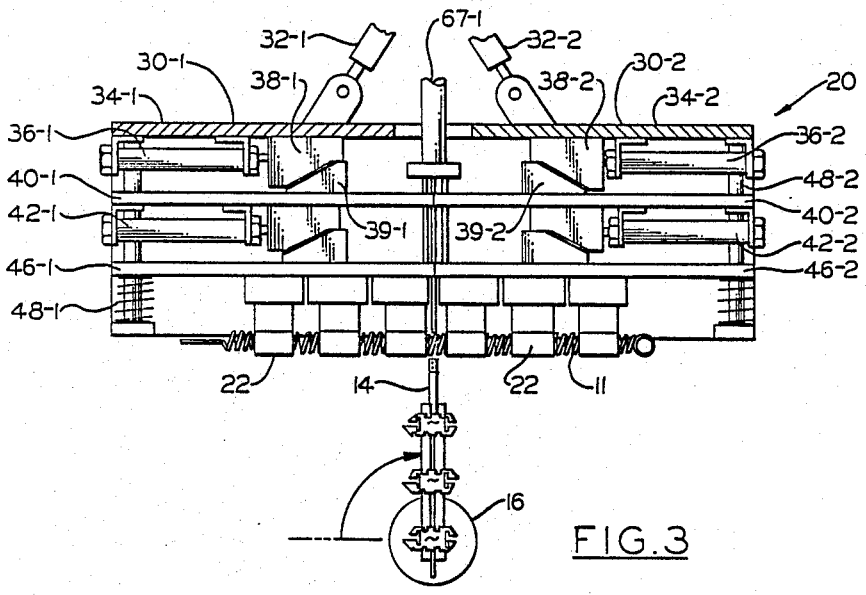
FIGS. 3–6 sequentially show the simplified movement of the fixture of FIG. 2, as viewed from above.

FIG. 3 is a simplified top view of fixture 20 as illustrated in FIG. 2 and FIGS. 3–6 sequentially show the movement of fixture 20 in forming the coil 11. The movement of the fixture 20 and the resultant folding of coil 11 is akin to that of the closing of a book. Fixture 20 includes a pair of doors 30-1 and 2 which are each moved through approximately 90° by hydraulic cylinders 32-1 and 2, respectively. Doors 30-1 and 2 include back walls 34-1 and 2, respectively. Back cylinders 36-1 and 2 are mounted on doors 30-1 and 2 and drive movable wedges or ramps 38-1 and 2, respectively, which are guided for reciprocating movement with respect to back walls 34-1 and 2 in any suitable conventional manner and coact with fixed wedges or ramps 39-1 and 2. Fixed wedges or ramps 39-1 and 2 are secured to one side of middle walls 40-1 and 2, respectively. Front cylinders 42-1 and 2 are mounted on doors 30-1 and 2 are drive movable wedges or ramps 44-1 and 2, respectively, which are guided for reciprocating movement with respect to middle walls 40-1 and 2 in any suitable conventional manner and coact with fixed wedges or ramps 45-1 and 2. Fixed wedges or ramps 45-1 and 2 are secured to one side of front walls 46-1 and 2, respectively. Adjustable coil retainers and spreaders 22 such as those disclosed in application Ser. No. 92,815 are secured to the other side of front walls 46-1 and 2.

With coil 11 manually or automatically located in place on fixture 20 as illustrated in FIG. 2, the simplified sequence of steps is shown in FIGS. 3–6. FIG. 3 is a simplified top view of the fixture 20 as depicted in FIG. 2 with all of cylinders 32-1 and 2, 36-1 and 2 and 42-1 and 2 in their retracted positions. Tree or rack 14 is placed in position, as by the rotation of a turntable 16, spaced a short distance from fixture 20. Dowel pins 50-1 and 2 are positioned so that coil 11 can be formed about them as will be explained in detail below. Specifically, pins 50-1 and 2 define the length and location of short legs or branches 11-5 and 11-7 and thereby define the lengths of long legs or branches 11-1 to 4. Cylinders 36-1 and 2 are then expanded causing movable ramps 38-1 and 2 to move and thereby wedge fixed ramps 39-1 and 2 from the FIG. 3 to the FIG. 4 position. Because fixed ramps 39-1 and 2 are secured to middle walls 40-1 and 2, their movement causes the movement of walls 40-1 and 2, cylinders 42-1 and 2, movable ramps 44-1 and 2, fixed ramps 45-1 and 2, front walls 46-1 and 2 and adjustable coil retainer and spreaders 22 towards dowel pins 50-1 and 2 and tree or rack 14 against the bias of springs of which only 49-1 to 4 are illustrated in the drawings. The springs 49-1 to 4, and others which are not illustrated, surround corresponding Thompson bars 48-1 to 6 and provide a return bias. The end of tree or rack 14 is received in opening 24. This motion of fixture 20 is guided by Thompson bars 48-1 to 6. Cylinders 32-1 and 2 are then expanded causing doors 30-1 and 2 to rotate from the FIG. 4 position to the FIG. 5 position. In the FIG. 5 position it will be noted that blades 51-1 and 4 are carried by doors 30-1 and 2, respectively, and that although coil 11 has been bent or formed generally into its final shape it still has not been placed on rack or tree 14. With motor driven adjustable coil retainers and spreaders 22 positioning the turns of the coil 11 as described in ppplication Ser. No. 92,815, cylinders 42-1 and 2 are then expanded causing movable ramps 44-1 and 2 to move and thereby wedge fixed ramps 45-1 and 2, respectively, to the FIG. 6 position against the further bias of springs of which only 49-1 to 4 are illustrated. Because fixed ramps 45-1 and 2 are secured to front walls 46-1 and 2, movement of ramps 45-1 and 2 causes corresponding movement of front walls 46-1 and 2 and the adjustable coil retainer and spreaders 22 which are adjustably secured to front walls 46-1 and 2. Accordingly, coil 11 is placed on insulators 18 of tree or rack 14. The reversal of these steps will release the tree or rack 24 with coil 11 in place thereon and with fixture 20 reset for receiving and forming another electric resistance coil 10.

Figure 11:
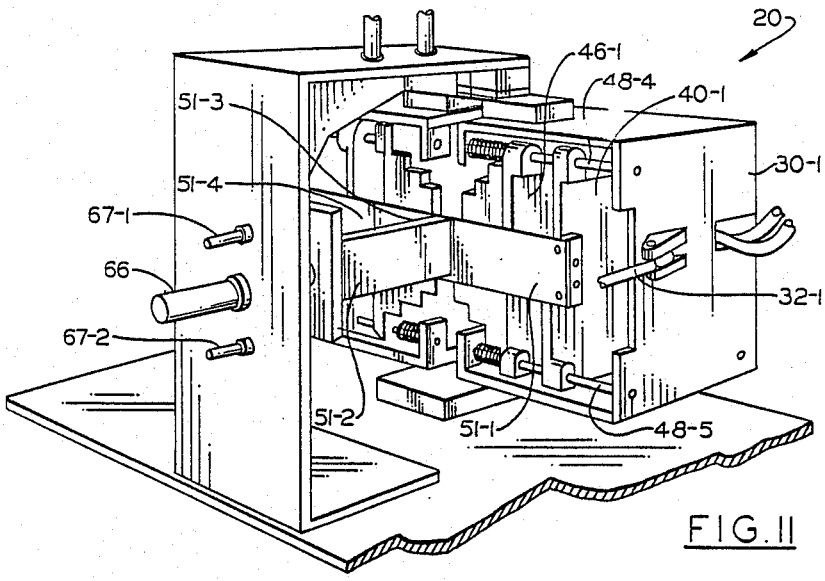
FIG. 11 is a perspective view of the fixture of the present invention in the position of FIGS. 6 and 10.
Figure 7:
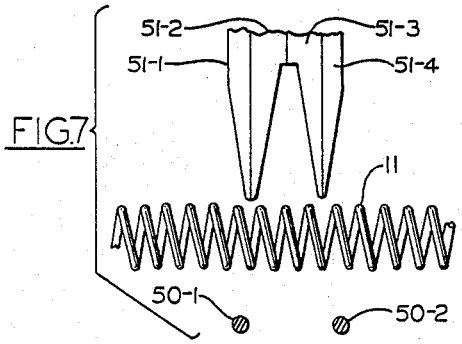
FIGS. 7–10 sequentially show the folding of the coil per se.
Figure 8:
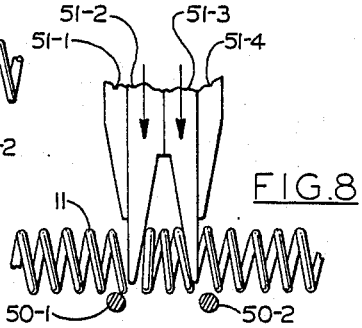
Figure 9:
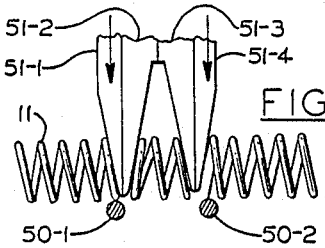
Figure 12:
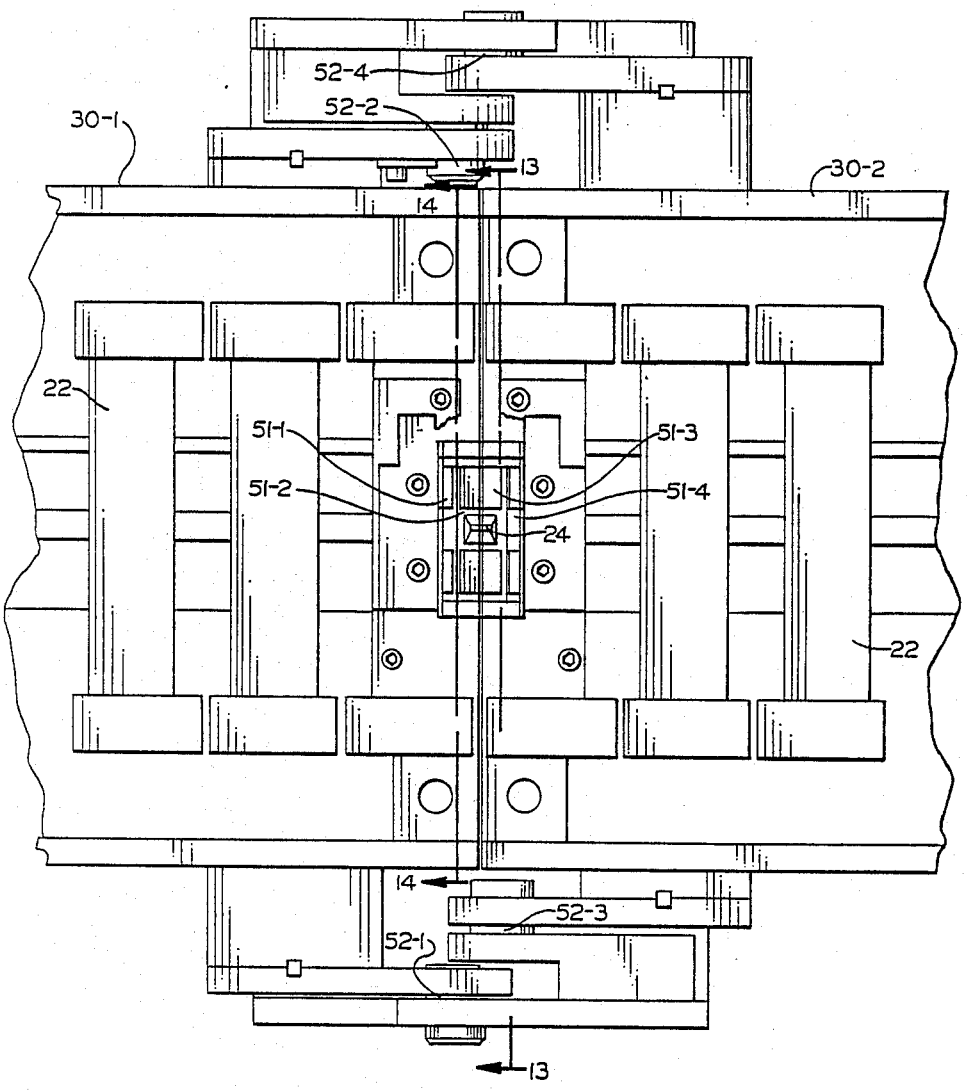
FIG. 12 is an enlarged view of a portion of FIG. 2 with the coil removed.
Figure 13:
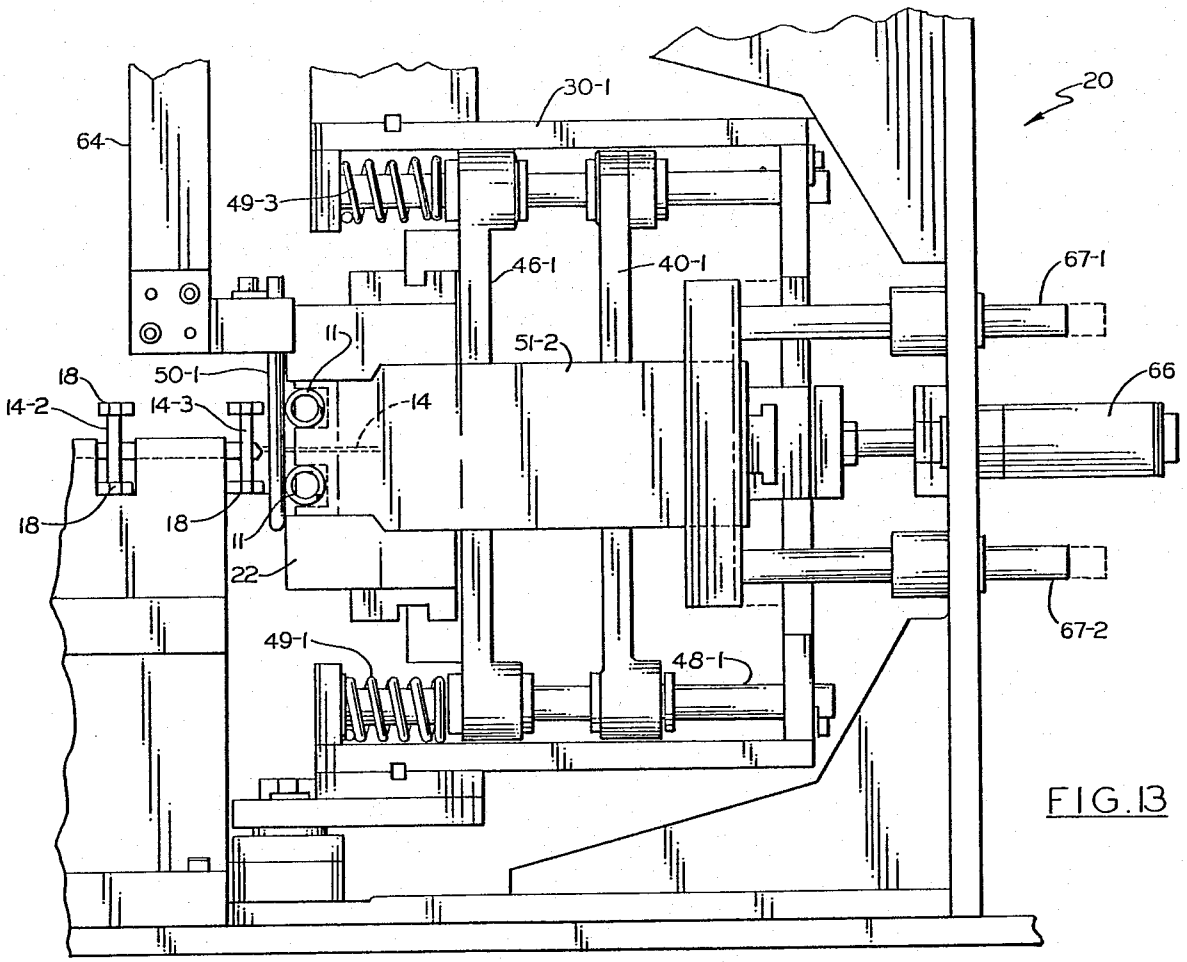
FIG. 13 is a sectional view taken along line 13—13 of FIG. 12.
Figure 14:
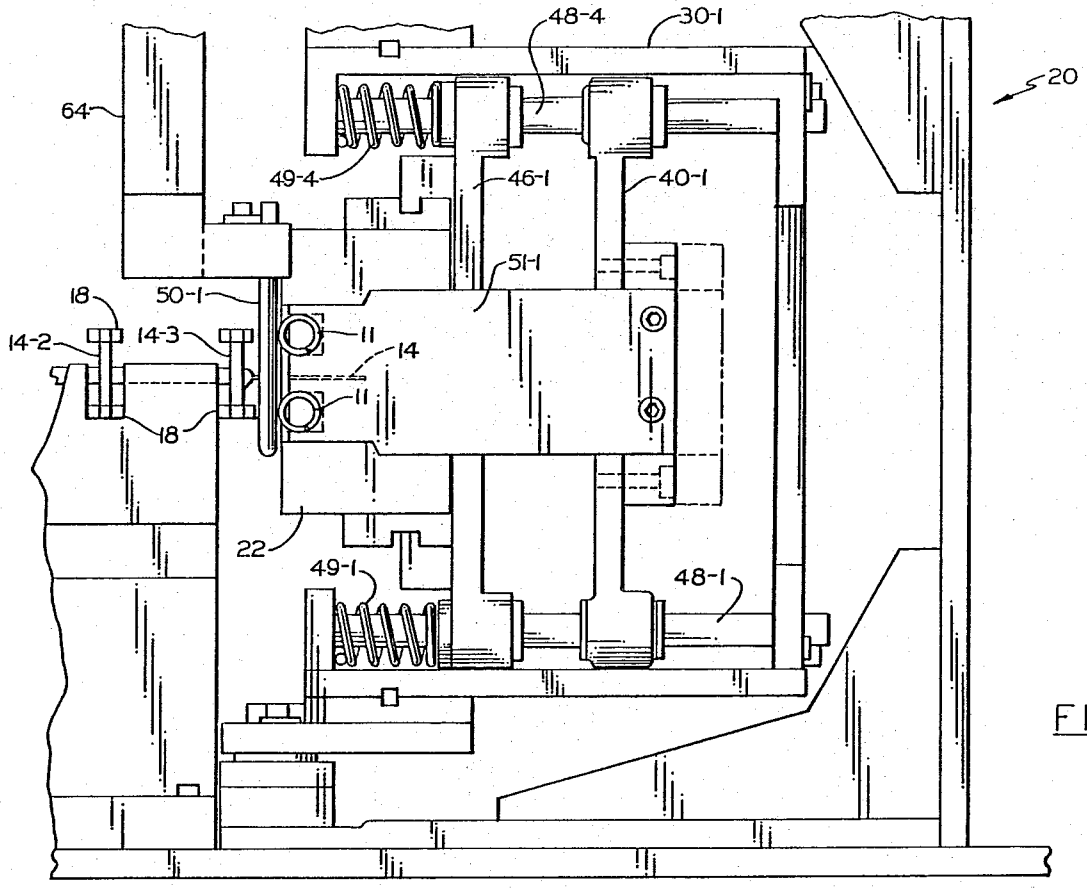
FIG. 14 is a sectional view taken along line 14–14 of FIG. I2.

The foregoing description while accurate is incomplete in that it fails to address a couple of problems. In the folding operation where doors 30-1 and 2 moved from the FIG. 4 to the FIG. 5 position steps must be taken to avoid stretching the wire of the coil and to have the correct number of turns in the correct location. In part, this requires the proper locating of adjustable coil retainers and spreaders 22 and adjustably spaced pins 50-1 and 2 with respect to coil 11. The positioning or spacing of pins 50-1 and 2 is done in conjunction with adjustable or replaceable blades 51-1 to 4, respectively, which are located on the opposite side of coil 11 from pins 50-1 and 2 as illustrated in FIG. 7. Blades 51-2 and 51-3, which are adjustably spaced, coact with pins 50-1 and 2 so as to be inserted at a proper spacing between the coils of coil 11. Blades 51-2 and 3 are moved between the coils of coil 11 as illustrated in FIG. 8 so as to receive a proper number of turns of coil 11. Blades 51-1 and 51-4 move with middle walls 40-1 and 2, respectively, so that as middle walls 40-1 and 2 move from the FIG. 3 to the FIG. 4 position, blades 51-1 and 4 move from the FIG. 8 to the FIG. 9 position. Additionally, as described above with respect to FIG. 4, front walls 46-1 and 2 are also moved which brings coil 11 to pins 50-1 and 2. It will be noted that blades 51-1 and 4 are respectively located between the same coils as blades 51-2 and 3, respectively. As doors 30-1 and 2 rotate from the FIG. 4 to the FIG. 5 position, blades 51-1 and 4 rotate from the corresponding FIG. 9 to the FIG. 10 position forming coil 11. In the FIG. 10 position, illustrated branches 11-4, 7 and 3 are clearly differentiated from the general coil 11 of FIG. 7 due to the rotation of blades 51-1 and 4. FIG. 11 is a pictorial view corresponding to FIG. 10 and shows more details of blades 51-1 to 4.

Figure 4:
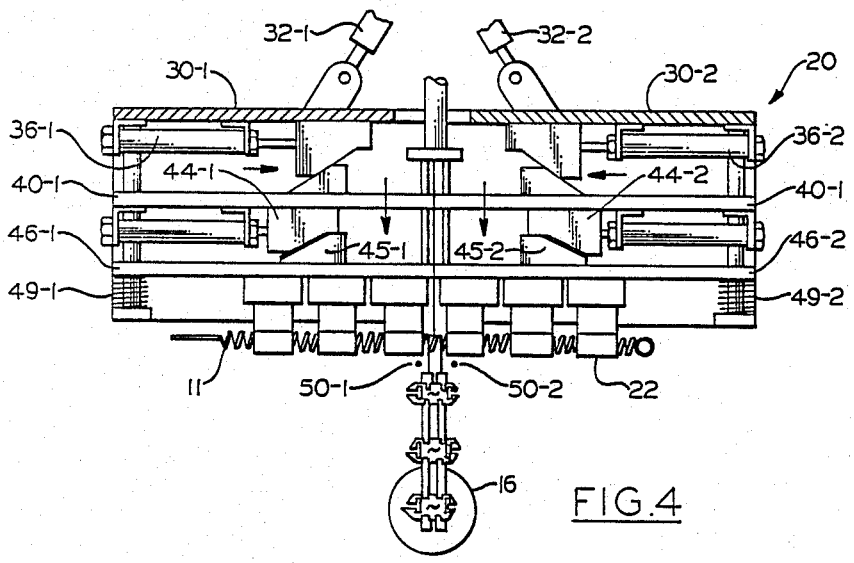
Figure 5:
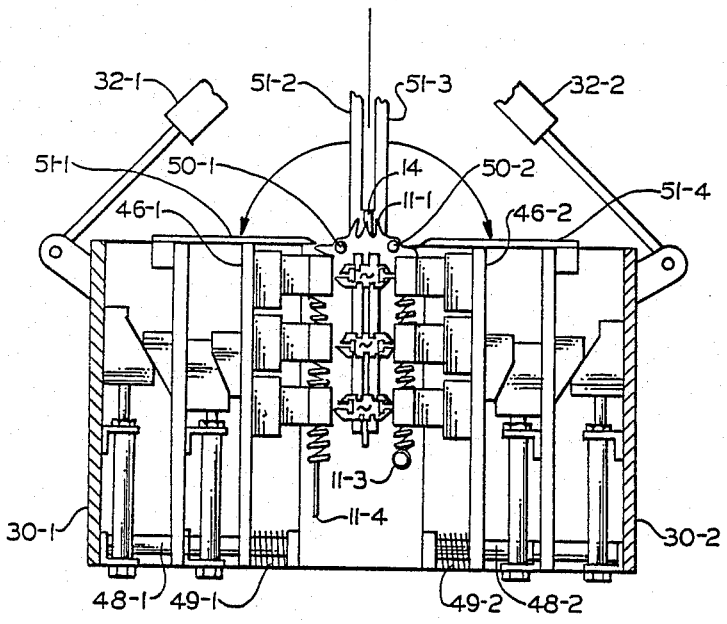
Figure 15:
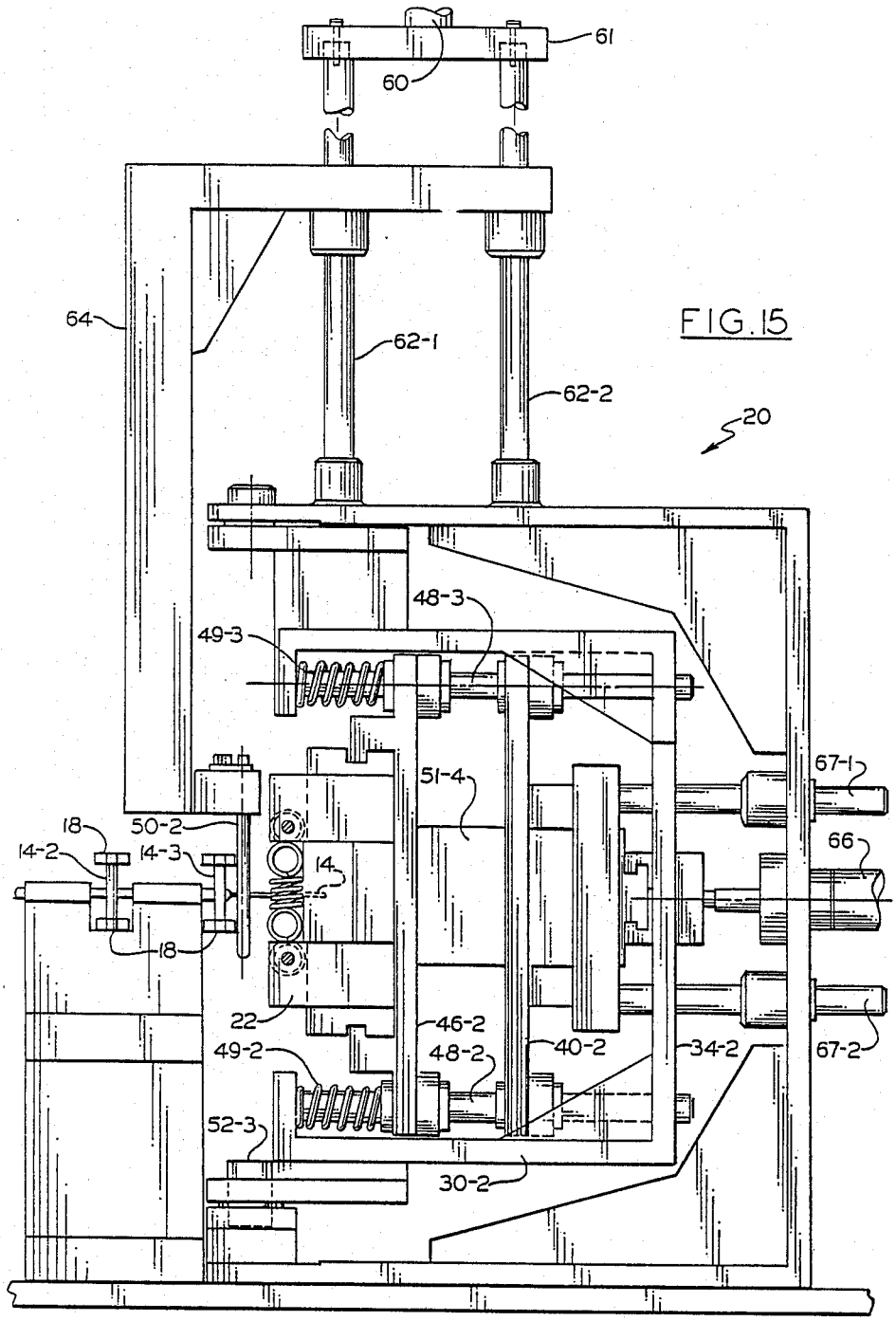
FIG. 15 is an end view of the FIG. 2 device.
Figure 16:
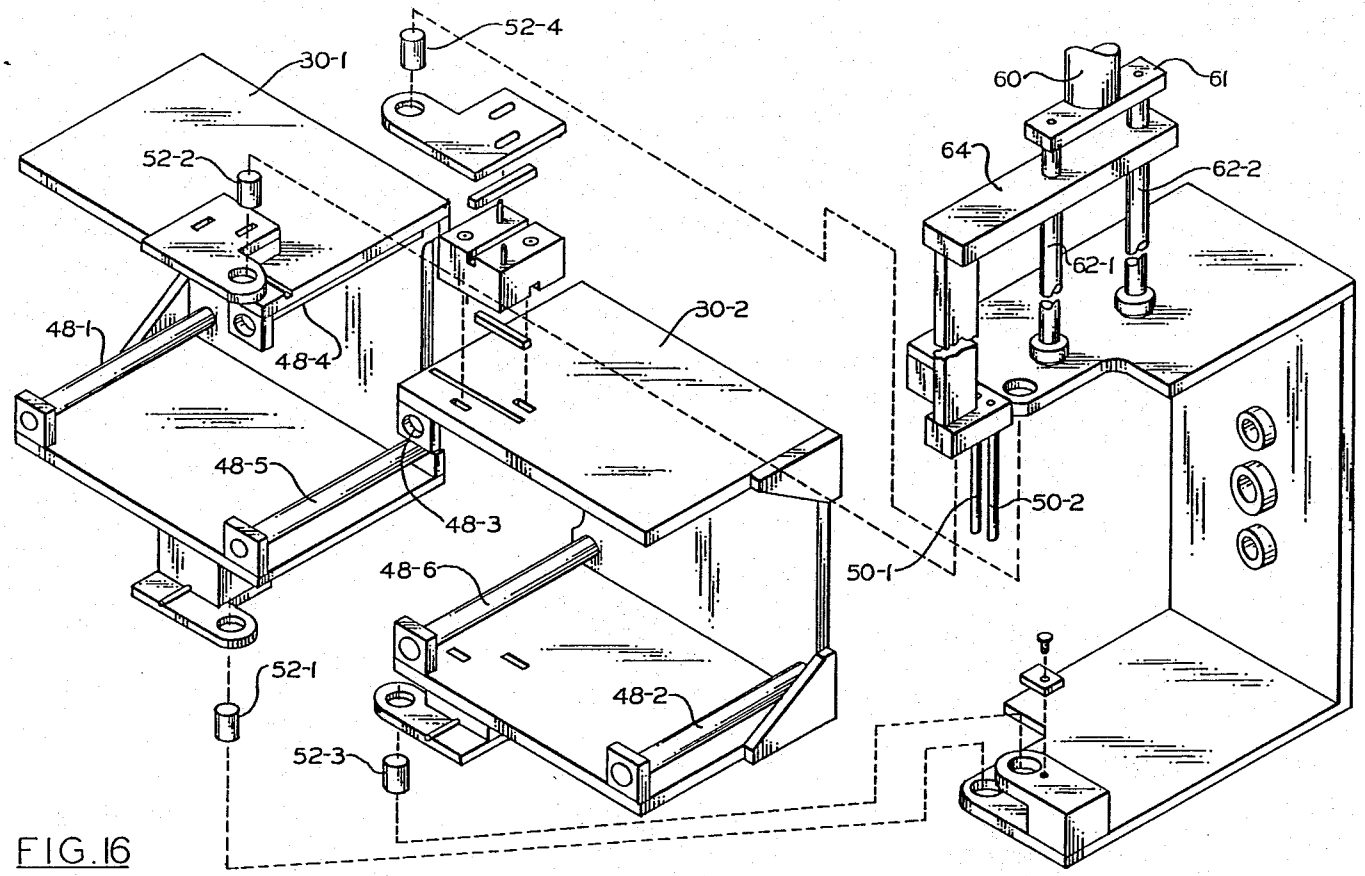
FIG. 16 is an exploded view of a portion of the FIG. 2 device.
Figure 17:
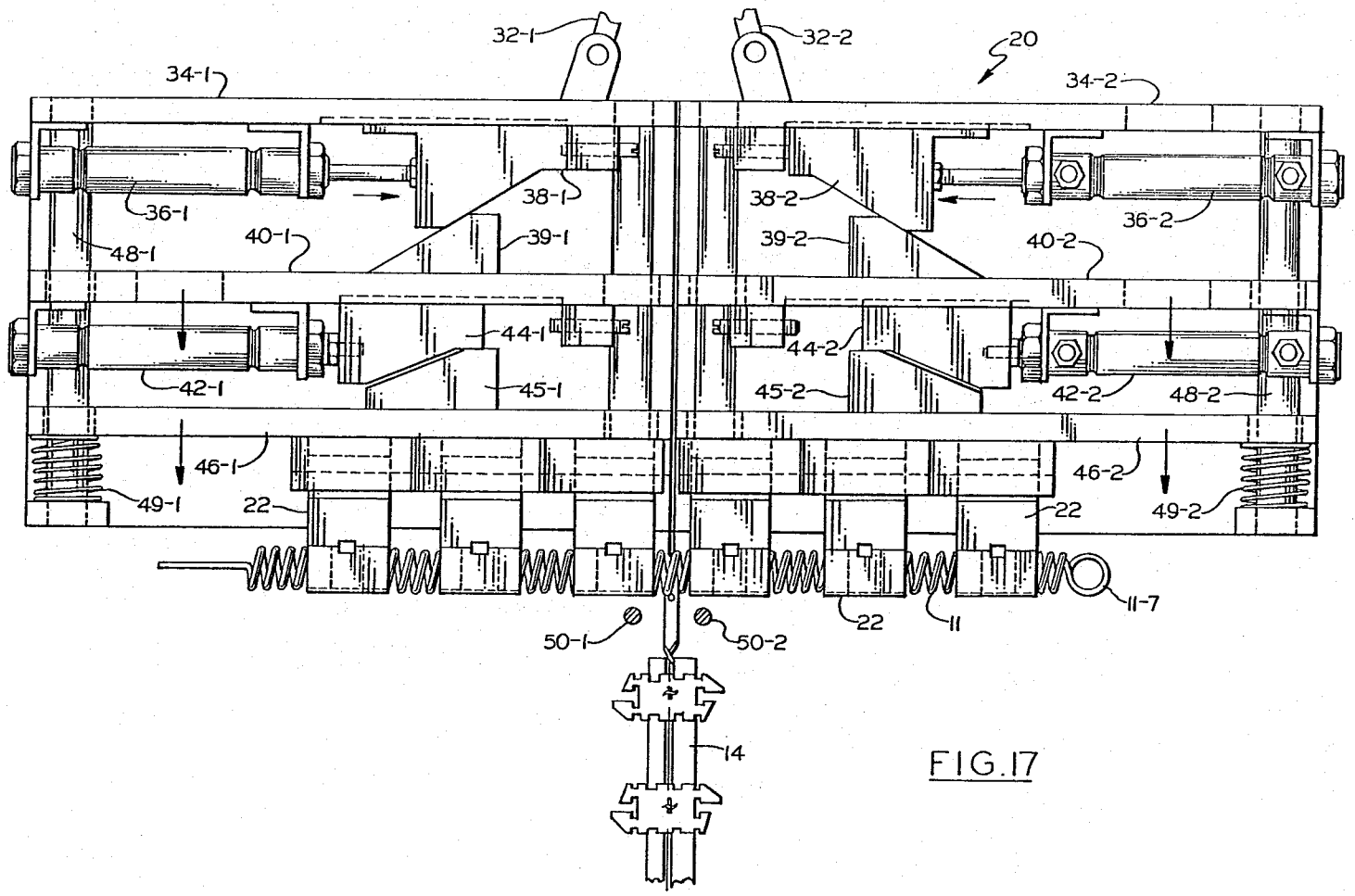
FIG. 17 is a more detailed version of FIG. 4.

In rotating doors 30-1 and 2 from the FIG. 4 to the FIG. 5 position, it is important that the coil 11 avoid being unnecessarily deformed due to pulling on the coil as this can stretch and thereby separate coils, cause improper numbers of turns to be located on various branches of the coil, can cause a drawing of the wire with a resultant localized increase of resistance, or the wire of the coil can be broken. To avoid these problems, it is necessary to pivot doors 30-1 and 2 in such a way that little, if any, stretching of coil 11 occurs. It will be noted from FIGS. 5 and 6 that doors 30-1 and 2 are separated, but parallel, in their extreme position. The hinge structure is illustrated in FIGS. 2, 12, 15 and 16. Door 30-1 pivots about lower pin 52-1 and upper pin 52-2 which are coaxial. Similarly, door 30-2 pivots about lower pin 52-3 and upper pin 52-4 which are coaxial but spaced from pins 52-1 and 2. Additionally, as best shown in FIGS. 15 and 16, pins 52-1 to 4 are located forward of the rest of the structure of the doors. As a result, when doors 30-1 and 2 are rotated from the FIG. 4 to the FIG. 5 position, the FIG. 5 position has the doors parallel and spaced by a distance that is determined by the offset between the axis of pins 52-1 and 2 and the axis of pins 52-3 and 4, as well as the distance the axes are forward of doors 30-1 and 2, respectively. The designed distance, or spacing, as illustrated in FIG. 5 will be a function of the dimensions of insulators 18 and the amount of movement of front walls 46-1 and 2 in going between the FIG. 5 and FIG. 6 positions.

FIGS. 2 and 11–17 present a more detailed view of fixture 20 and the operations described with respect to FIGS. 3–10 will now be amplified. It should be noted initially that some structure has been illustrated in only one view so as to permit other structure to be viewed. Starting with FIG. 2 and its corresponding top view in FIG. 3, the U-shaped coil 11 is located on adjustable coil retainers and spreaders 22 whose number and location are dictated by the number and spacing of insulators 18. In going from the FIGS. 3 and 7 to the FIGS. 4 and 9 position, cylinder 60 is expanded causing the downward movement of plate 61 which is secured to Thompson bars 62-1 and 2. Downward movement of plate 61 causes corresponding downward movement of C-shaped member 64 which carries pins 50-1 and 2. Thus, pins 50-1 and 2 are moved to the position of FIGS. 4, 7–10 and 13–15. Cylinder 66 which is guided by Thompson bars 67-1 and 2 is expanded to move blades 51-2 and 3 from the FIG. 7 position to the FIG. 8 position. Cylinders 36-1 and 2 would be powered and cause middle walls 40-1 and 40-2 to move forward due to the wedging action between movable ramps 38-1 and 2 and the corresponding fixed ramps 39-1 and 2. This movement of middle walls 40-1 and 2 produces a corresponding movement of front walls 46-1 and 2 against the bias of springs, of which 49-1 to 4 are illustrated, causing the end of tree or rack 14 to be received in fixture 20 and to bring coil 11 to pins 50-1 and 2. Blades 51-1 and 4 are secured to and move with middle walls 40-1 and 2, respectively. So the movement of middle walls 40-1 and 2 due to the powering of cylinders 36-1 and 2 causes blades 51-1 and 4 to move from the FIG. 8 position to the FIG. 9 position. Cylinders 32-1 and 2 would then be expanded causing doors 30-1 and 2 to rotate 90. from the FIGS. 4, 9 and 17 position to the FIGS. 5 and 10 position. As doors 30-1 and 2 are being pivoted due to the action of cylinders 32-1 and 2, blades 51-1 and 4 engage and deform coil 11 in moving from the FIG. 9 to the FIG. 10 position. Because doors 30-1 and 2 pivot about different axes defined by pins 52-1 and 2 and by pins 52-3 and 4, wire coil 11 is not subjected to stretching or compressing forces to any significant extent. The coil 11 is thus not deformed since it is a spring in appearance only and lacks the resiliency to return to its shape after significant deformation such as would be in the case if doors 30-1 and 2 pivoted about a common axis. It should be noted that the axis defined by pins 52-1 and 2 and by pins 52-3 and 4, in addition to being spaced as shown in FIG. 2, are also forward of the rest of the doors 30-1 and 2 as best shown in FIGS. 13–16.

Figure 10:
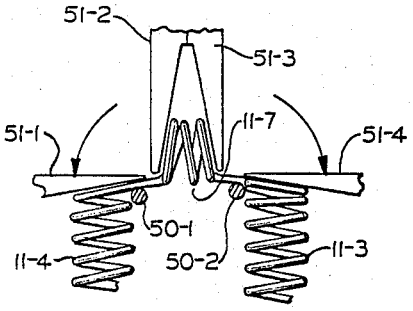

The coil 11, in the FIGS. 5 and 10 position, has appropriate turns of the coil 11 wedged apart by the cams of adjustable coil retainers and spreaders 22, as described in co-pending U.S. application Ser. No. 92,815. When cylinders 42-1 and 2 are powered, movable ramps or wedges 44-1 and 2, respectively, are driven from the FIG. 5 to the FIG. 6 position thereby causing the movement of front walls 46-1 and 2 against the bias of springs, of which 49-1 to 4 are illustrated, which are carrying adjustable coil retainers and spreaders 22. The differentiation of legs or branches 11-1 to 5 and 7 of coil 11 is thereby achieved. Because appropriate turns of the coil 11 have been wedged apart, movement of the front walls 46-1 and 2 and adjustable coil retainers and spreaders 22 result in the arms of the insulator block 18 being inserted into the gaps defined by the wedged apart turns of coil 11. Two turns of coil 11 will then be located in the T-slot defined between each pair of arms of insulator block 18, if the cams of coil retainers and spreaders 22 are then reversed so that they no longer create a wedging action, the turns of the coil in each T-slot will move to the ends of the cross bar portion of the T-slot thereby securing coil 11 to tree or rack 14.

Figure 6:
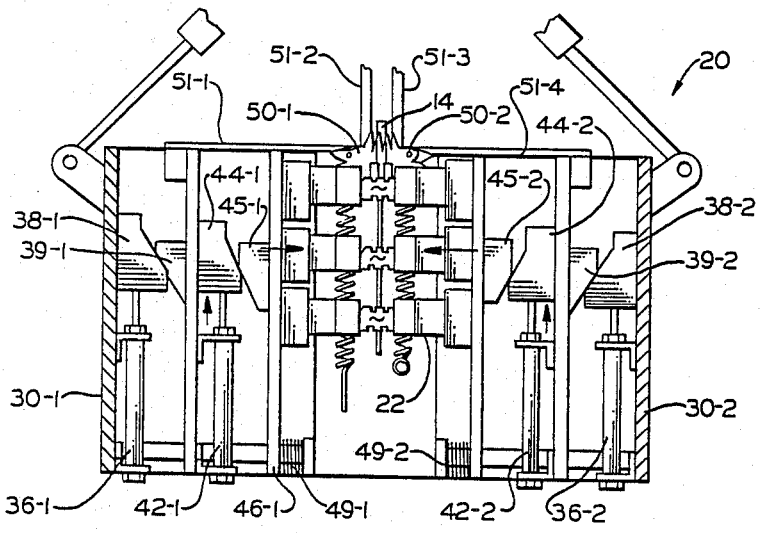

Since coil 11 is secured to tree or rack 14, the movement of cylinders 42-1 and 2 from the FIG. 6 to the FIG. 5 position withdraws coil retainers 22 from coil 11 which is then in place on tree or rack 14. Fixture 20 is serially sequenced from the FIG. 6 position to the FIG. 3 position by reversing the previously described procedure. Tree or rack 14 with coil 11 in place is then taken to the next processing step and fixture 20 is ready to receive another coil 11, as shown in FIG. 2, and the above-described process is repeated.

Although a preferred embodiment of the present invention has been illustrated and described, other changes will occur to those skilled in the art. For example, cylinders 36-1 and 42-1 and cylinders 36-2 and 42-2 may be replaced with single cylinders having two cams so that the cylinders are actuated in two steps to achieve movement corresponding to that of FIGS. 4 and 6, respectively. The sequence of FIGS. 8 and 9 can be reversed. Blades 52-2 and 3 can be driven individually or together. It is therefore intended that the scope of the present invention is to be limited only by the scope of the appended claims.

I claim:

1. A method for installing a coiled electric heater element onto insulators comprising the steps of:

placing a U-shaped coiled electric heater element having two long legs connected by a shorter leg onto a fixture having two rotatable elements such that a portion of each of the two long legs of the U-shaped element is located on each of said rotatable elements with said two long legs being generally in the same plane;

locating a rack having a plurality of insulators with respect to the fixture;

relatively moving the fixture with respect to the rack;

locating a spaced pair of pins parallel to the plane of the two long legs;

rotating the rotatable elements and thereby bending each of the two long legs about a radius respectively defined by each of the pins whereby each of the long legs is bent into a U-shape with the four legs defined by bending about the pins being located in parallel and spaced from the rack; and advancing the four parallel legs toward the rack and placing the heater element on the insulators.

2. The method of claim 1 wherein the step of rotating the rotatable elements includes the step of rotating each of the rotatable elements about a different axis.

3. The method of claim 1 further including the step of inserting a pair of blades between the coils of the heater element at the locations of the pins and rotating one of each pair of blades with each of said rotatable elements.

4. A fixture for forming electric heater elements and installing them on insulators comprising:

first and second pivotable means pivotable about different axes and movable from a first position in which said first and second pivotable means are in generally in the same plane to a second position in which said first and second pivotable means are in a spaced generally parallel relationship;

a U-shaped coil having a pair of spaced parallel legs;

a plurality of adjustable coil retaining and spreading means;

first and second wall means forming a portion of said first and second pivotable means, respectively, and each of said first and second wall means including means for positioning a plurality of said adjustable coil retaining and spreading means thereon so as to be adapted to receive and secure said U-shaped coil therein when said first and second pivotable means are in said first position;

a pair of spaced pins parallel to and in proximity with said different axes and relatively movable into and out of proximity with said U-shaped coil;

two pair of blade means adapted to be moved between coils of said legs of said U-shaped coil at positions corresponding to and on the opposite side of said U-shaped coil from said pair of spaced pins;

means for pivoting said first and second pivotable means together with one blade from each of said two pair of blade means from said first position through approximately 90° to said second position and thereby bending said legs of said U-shaped coil into U-shapes.

5. The apparatus of claim 4 further including means for advancing said first and second wall means when in said second position to thereby move and place said bent U-shaped legs onto insulators carried by a rack.

6. The apparatus of claim 4 further including means for guiding movement of said first and second wall means.

7. The apparatus of claim 4 wherein said pair of pins are adjustably spaced.

8. The apparatus of claim 4 wherein said pairs of blades are adjustably spaced.

9. The apparatus of claim 4 wherein one blade of each pair of blades moves with the corresponding one of said first and second wall means.

10. The apparatus of claim 4 further including means for selectively locating said plurality of adjustable coils relating and spreading means.

11. A fixture for forming electric heater elements from a U-shaped coil having a pair of spaced parallel legs and installing them on insulators comprising:

first and second pivotable means pivotable about different axes and movable from a first position in which said first and second pivotable means are in generally in the same plane to a second position in which said first and second pivotable means are in a spaced generally parallel relationship;

a plurality of adjustable coil retaining and spreading means;

first and second wall means forming a portion of said first and second pivotable means, respectively, and each of said first and second wall means including means for positioning a plurality of said adjustable coil retaining and spreading means thereon so as to be adapted to receive and secure a U-shaped coil therein when said first and second pivotable means are in said first position;

a pair of spaced pins parallel to and in proximity with said different axes and relatively movable into and out of proximity with a U-shaped coil;

two pair of blade means adapted to be moved between coils of the legs of a U-shaped coil at positions corresponding to and on the opposite side of a U-shaped coil from said pair of spaced pins;

means for pivoting said first and second pivotable means together with one blade from each of said two pair of blade means from said first position through approximately 90° to said second position and thereby bending said legs of a U-shaped coil into U-shapes.

* * * * *